US010634444B2

(12) United States Patent
Couvillion

(10) Patent No.: US 10,634,444 B2
(45) Date of Patent: Apr. 28, 2020

(54) METHOD AND APPARATUS FOR PARALLEL PATH FIREARM SOUND SUPPRESSION

(71) Applicant: Roy J. Couvillion, Lafayette, LA (US)

(72) Inventor: Roy J. Couvillion, Lafayette, LA (US)

( * ) Notice: Subject to any disclaimer, the term of this patent is extended or adjusted under 35 U.S.C. 154(b) by 0 days.

(21) Appl. No.: 15/875,647

(22) Filed: Jan. 19, 2018

(65) Prior Publication Data

US 2018/0224235 A1 Aug. 9, 2018

Related U.S. Application Data

(60) Provisional application No. 62/448,438, filed on Jan. 20, 2017.

(51) Int. Cl.
*F41A 21/30* (2006.01)

(52) U.S. Cl.
CPC ..... *F41A 21/30* (2013.01)

(58) Field of Classification Search
CPC ..... F41A 21/30
USPC ..... 89/14.4
See application file for complete search history.

(56) References Cited

U.S. PATENT DOCUMENTS

| | | | | |
|---|---|---|---|---|
| 7,931,118 | B1 * | 4/2011 | Cronhelm | F41A 21/30 181/223 |
| 8,307,946 | B1 * | 11/2012 | Johnston | F41A 21/30 181/223 |
| 9,038,771 | B1 * | 5/2015 | Mueller | F41A 21/30 181/223 |
| 9,599,421 | B1 * | 3/2017 | Dean | F41A 21/30 |
| 2011/0132683 | A1 * | 6/2011 | Miller | F41A 21/30 181/223 |
| 2011/0186377 | A1 * | 8/2011 | Kline | F41A 21/30 181/223 |
| 2014/0190345 | A1 * | 7/2014 | Daniel | F41A 21/325 89/193 |
| 2017/0102201 | A1 * | 4/2017 | Bush | F41A 21/30 |
| 2018/0321008 | A1 * | 11/2018 | Barney | F41A 21/30 |

* cited by examiner

*Primary Examiner* — Bret Hayes
(74) *Attorney, Agent, or Firm* — Ted M. Anthony; Sarah B. Dupont

(57) ABSTRACT

A parallel path firearm sound suppressor assembly is provided for use in suppressing a plurality of noises and a visible flash generated by the release of gases that is generated by burning solid propellant from a firearm muzzle. A parallel path firearm sound suppressor assembly is provided that comprises an outer sleeve, a base, and a monolithic baffle for use in trapping burning and unburned propellant, and thus, distributing heat to avoid damage to said parallel path firearm sound suppressor assembly.

2 Claims, 12 Drawing Sheets

METHOD AND APPARATUS FOR PARALLEL PATH FIREARM SOUND SUPPRESSION

BACKGROUND OF THE INVENTION

1. Field of the Invention

The present invention pertains to a sound suppressor assembly for use in suppressing a variety of noises and a visible flash that are typically generated by the release of a plurality of gases and exploding propellant from a firearm muzzle. More particularly, the present invention pertains to a parallel path firearm sound suppression method and a device assembly to facilitate said method for use in achieving substantially hearing-safe sound attenuation, while being substantially easy and efficient to disassemble for cleaning, service, maintenance, or any other similar need.

2. Brief Description of the Prior Art

Silencers contain the explosive expansion of gas and burning propellant released from a firearm barrel. They also provide additional time and space within which propellant continues to burn before being discharged from a device. In conventional silencer designs, the solid and burning propellant is suspended within the gas flow stream using turbulence deliberately produced within a plurality of separate chambers within the device. In so doing, conventional designs retard the rate of flow through the device in order to provide time for the propellant to burn.

With few exceptions, conventional firearm silencer designs generally adhere to the Maxim concept of a series of baffles separating a volume within a container into a plurality of separate volumes, thereby defining a method by which firearm blast suppression must occur sequentially and progressively throughout those similarly designed features and volumes. Blast containment in the primary volumes generates extreme heat and pressures within the device. These are often addressed with an increase in the physical size of the device, such as, for example, cross-sectional area and length, permanently welding/sealing the device, and/or fashioning a plurality of openings, known commonly as "mouse holes", to equalize pressure and generate turbulence. These efforts to maximize sound suppression are often accomplished at the expense of other practical considerations, such as accuracy, size, weight, expense, and serviceability.

Additionally, the concept of a series of baffles separating the volume of a cylindrical container into separate volumes is evident even in the most modern designs of a "silent firearm." With use restricted to primarily military applications, efforts to maximize sound attenuation have taken precedent over other parameters such as size, weight, and serviceability. Even with growing civilian and law enforcement use, sound attenuation has become the metric by which silencers are typically compared and other characteristics such as weapon system backpressure, size and weight, muzzle flash, and firearm accuracy are scarcely mentioned. As the number of silencers in civilian use approach and exceed those in military use, these secondary performance characteristics have become more important.

It is not uncommon for a civilian firearm owner to spend approximately a week's wages on a firearm scope with the intention of improving shot placement. Hunters waiting for the optimum moment to take a shot typically do not need the added strain of a substantially heavy device on the end of a long rifle. Likewise, a law enforcement tactical team working in a relatively close-quarters environment, such as a residential building, is hindered by substantially longer devices. Further, excessive propellant gas blowback with semi-automatic firearms is both an immediate danger and a long-term health hazard. Hunters with both a substantially large caliber rifle and a substantially small caliber rim-fire pistol are quite common and often use a single large caliber silencer for both purposes. Since rim-fire ammunition is generally associated with heavy lead and unburned propellant deposits, even occasional use can destroy a substantially large caliber silencer that cannot be disassembled and cleaned.

Conventional baffle designs that improve sound attenuation typically increase backpressure and adversely affect bullet stability. Increasing size has addressed these backpressure issues, but has become more cumbersome. Weight can be addressed with substantially lightweight materials, such as titanium, but with a greater cost and expense. The very high pressures in the initial chambers can be addressed by welding the devices closed and thus rendered unserviceable.

While many of these issues are being successfully addressed with improvements to the conventional design, it has become evident that these efforts are yielding diminishing returns and quite often, those returns come with a compromise in other design parameters. For example, a conventional silencer designed for use with a high-pressure rifle round may function on a substantially small caliber pistol using rim-fire ammunition, but such a device is generally impracticably physically large and heavy compared to the smaller weapon. Further, it is known that deposits from firing rim-fire ammunition common to small caliber firearms can foul and occlude the internal chambers of silencers.

In contrast, rim-fire silencers are generally physically small and lightweight and designed to be completely disassembled for cleaning, whereas silencers for high-pressure rounds can be at least partially permanently sealed. Conventional rim-fire silencer designs generally limit their ability to withstand high heat and high pressure, which precludes them from use on weapons using high-pressure ammunition.

Thus, there is a need for a method and a device facilitating said method that can achieve hearing-safe sound attenuation in a substantially small and lightweight package. Further, there is a need for a device that can be easily disassembled for more efficient cleaning or service. Additionally, there is a need for a device that can accomplish these objectives while creating minimal backpressure and that does not adversely affect shot placement.

SUMMARY OF THE INVENTION

The present invention comprises a parallel path firearm sound suppressor assembly that suppresses a plurality of noises and a visible flash generated by the release of gases generated by burning solid propellant and burning solid propellant from a firearm muzzle. This is commonly and collectively referred to as firearm "blast suppression", and the devices used to accomplish this are commonly referred to as "silencers" or "suppressors." The device comprises a plurality of chambers within which are features influencing the flow of gases and deposition of solids as they progress through the device. Some of the chambers or features of the device can additionally influence the direction of gases to direct forces created by the gases ejecting from the device.

In a preferred embodiment, the sound suppressor assembly of the present invention and the method of using same takes advantage of particle motion physics to separate solid propellant from fluid flow stream of the produced propellant gases. Features of the device induce gases of the solid and gas suspension to change direction while some of the solids continue independent of the flow in a substantially straight line into a plurality of features of the device that are substantially removed from the flow stream. As a result, within the device of the present invention, gases and solids are made to travel through separate but substantially parallel paths a solids path and a gases path.

Within the "solids path," the propellant particles are captured within a plurality of areas that are partially isolated from the gaseous flow and wherein some of the solids are deposited. These burning particles generate gas which reenters the flow stream.

Within the "gases path," propellant gases that are cleaned of some burning propellant solids are routed to allow for more complete combustion and cooling before leaving or exiting the device. A diverter vane member and its relative position to a plurality of holes that are created by a bullet pathway hole force the high velocity gases to change direction in order to continue to flow through the device. Particles that are carried within the flow stream tend to flow in a substantially straight line. The fluid flow path that is defined by these features allows the particles to flow to a plurality of pockets as the gases flow through to the next chamber. As a result, these gases are carrying substantially fewer burning particles to expel at a distal end of the device of the present invention.

As such, the sound suppressor assembly of the present invention can separate the solids from the gaseous flow and retain said solids within areas that are relatively isolated from the gaseous flow path. Once separated from the gaseous flow, the solids can move toward and within a volume that is substantially parallel to the gaseous flow until deposited within said volume. Thus, the present invention further allows a user to be able to disassemble the device and to access the areas of accumulated deposits in order to properly and effectively clean said sound suppressor assembly of the present invention.

In a preferred embodiment, the sound suppressor assembly of the present invention comprises an open outer container, or cylinder, having a first end and a second end, wherein said outer cylinder is able to receive a monolithic baffle member. Said baffle member can optionally employ some or all of the features of the invention as necessary in order to achieve a desired effect for a specific application of the device. The present invention further comprises a base member, wherein said base is used to bind said outer cylinder and said baffle member into a coaxial assembly and thus provide a means to affix the sound suppressor assembly of the present invention to an end of a firearm.

In a preferred embodiment, the present invention comprises a device that can withstand heat and pressure of high-pressure ammunition and that can be completely disassembled and maintained by the user. Further, in a preferred embodiment, said sound suppressor assembly of the present invention can be manufactured in a substantially similar size to a conventional rim-fire silencer, can be completely disassembled, and can withstand a variety of different conditions of high-pressure ammunition.

BRIEF DESCRIPTION OF THE DRAWINGS

The foregoing summary, as well as any detailed description of the preferred embodiments, is better understood when read in conjunction with the drawings and figures contained herein. For the purpose of illustrating the invention, the drawings and figures show certain preferred embodiments. It is understood, however, that the invention is not limited to the specific methods and devices disclosed in such drawings or figures.

DETAILED DESCRIPTION OF A PREFERRED EMBODIMENT

Figure 1:
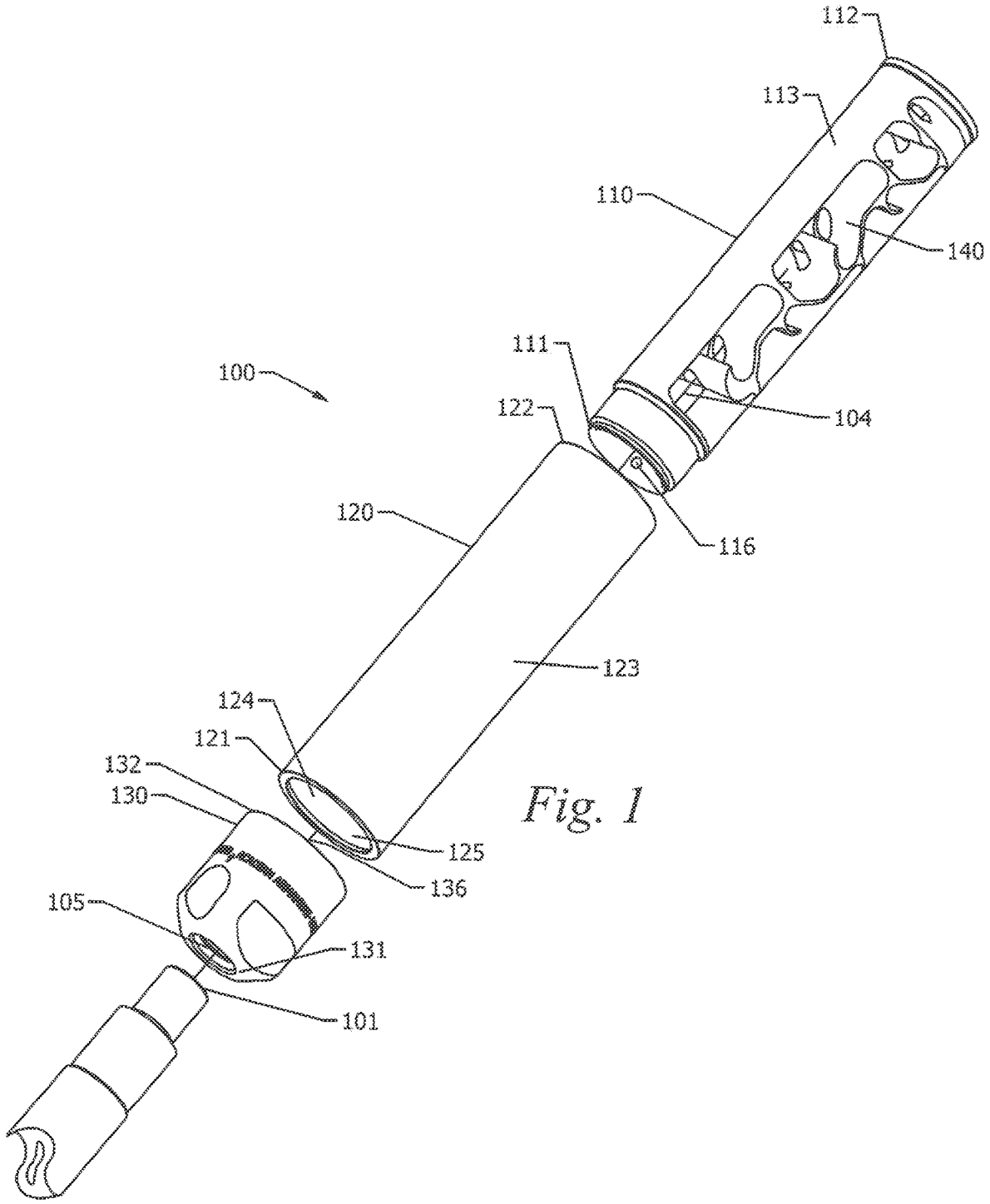
FIG. 1 depicts an exploded perspective view of a preferred embodiment of a parallel path firearm sound suppressor assembly of the present invention.

Referring to the drawings, a firearm sound suppressor assembly 100 of the present invention provides a means to optimize firearm suppressor efficiency with regards to maximizing sound attenuation, preserving the stability and ballistic integrity of a bullet fired through said sound suppressor assembly, minimizing the physical size and weight of said assembly, and the ability to completely disassemble said assembly by a user who is generally skilled and equipped to maintain a firearm.

In a preferred embodiment, sound suppressor assembly 100 of the present invention can be manufactured from a variety of substantially high strength metals, such as, for example, titanium and Inconel, substantially high tensile strength aluminum alloys and stainless steel, or even composite materials and plastics, or any other similar material having like characteristics. Further, the present invention can be manufactured in a variety of different sizes, wherein the overall size of the sound suppressor assembly 100 and the relative sizes of the separate containers are dependent upon a user's specific application, firearm device, and desired physical and sound characteristics.

In a preferred embodiment, FIG. 1 depicts an exploded perspective view of sound suppressor assembly 100 generally comprising an outer cylinder, or sleeve, 120, a monolithic baffle 110, and a base member 130. Outer cylinder 120 comprises an outer diameter 123 and an inner diameter 124, thereby defining an inner pathway, or chamber 125, for receiving monolithic baffle 110. Additionally, outer cylinder 120 comprises a proximal end 121 and a distal end 122, wherein proximal end 121 is adjacently aligned to, and thus, closed by base member 130. Thus, proximal end 121 of outer cylinder 120 is impinged between monolithic baffle 110 and base member 130, thereby allowing baffle member 110 to be able to expand longitudinally within outer sleeve 120.

Monolithic baffle member 110 comprises a substantially cylindrical body member, having an outer diameter 113, a proximal end 111 and a distal end 112, wherein proximal end 111 is threadably affixed to, and thus, closed by base member 130. Outer diameter 113 of monolithic baffle 110 is substantially less than inner diameter 124 of outer cylinder 120, thereby allowing baffle 110 to be received within inner chamber 125 of outer cylinder 120. Body member of monolithic baffle 110 comprises a plurality of interior openings, or chambers 140, in order to produce a specific effect, such as, for example, solid and fluid separation. Additionally, monolithic baffle 110 further comprises a bullet pathway hole 104, wherein said bullet pathway hole 104 breaches the entirety of baffle member 110 along a longitudinal axis, from proximal end to distal end.

In a preferred embodiment, base member 130 comprises a substantially cylindrical configuration, having a proximal end 131 and a distal end 132, wherein distal end 132 is threadably affixed to monolithic baffle 110. Base member 130 further comprises a through-hole 105 that is coaxial to bullet pathway hole 104 of baffle 110, wherein through-hole 105 provides a means to attach sound suppressor assembly 100 directly to a firearm muzzle 101 or to accommodate sound suppressor assembly 100 to selectively attach to a firearm muzzle 101. As such, an end of sound suppressor assembly 100 defined by base member 130 is hereinafter referred to as the proximal end of the device 100 and the opposite end is hereinafter referred to as the distal end of the device 100.

Figure 2:
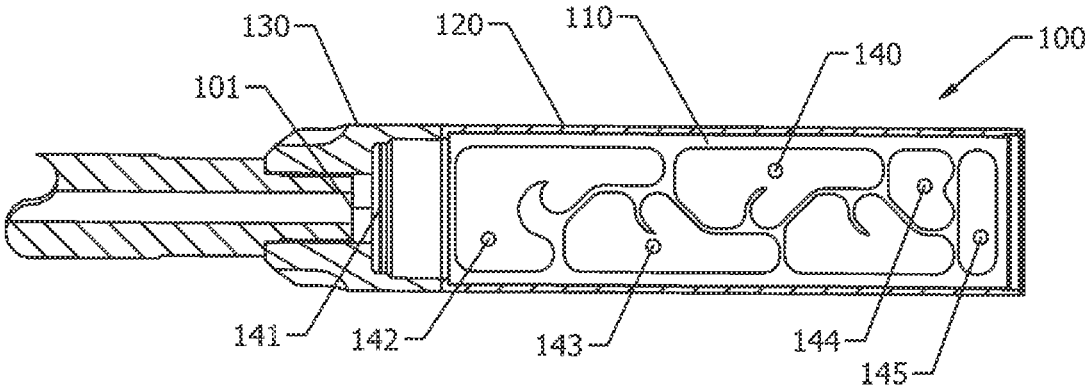
FIG. 2 depicts a sectional view of a preferred embodiment of a parallel path firearm sound suppressor assembly of the present invention.

FIG. 2 depicts a longitudinal sectional view of sound suppressor assembly 100 in an assembled configuration, wherein base 130 is used to attachably connect outer cylinder 120 and baffle member 110 to a firearm muzzle 101 by way of a threaded connection. By way of illustration, but not limitation, base 130 can be used to attachably connect to firearm muzzle 101, or any other similar device that can be attached to an end of a firearm muzzle, by way of a threaded connection, or any other similar attachment means. Monolithic baffle 110 is received within outer cylinder 120 of sound suppressor assembly 100 and attachably connected to base member 130, wherein baffle 110 further comprises a plurality of chambers 140 that are substantially independent of each other, except for any openings that are created by bullet pathway hole 104.

As depicted in FIG. 2, baffle member 110 is received within inner chamber 125 of outer cylinder 120, wherein outer diameter 113 of baffle member 110 is slightly less than inner diameter 124 of outer cylinder 120. Further, body member of monolithic baffle 110 comprises chambers 140 in order to produce a specific effect, such as, for example, solid and fluid separation. Thus, a proximal chamber 141 is formed by the combination of a threaded cavity 136 on the distal end 132 of base member 130 and a cavity 116 within the mating threaded feature on the proximal end 111 of baffle member 110.

Additionally, a first chamber 142 of baffle 110, a plurality of subsequent chambers 143, a transition chamber 144 and a gas alignment chamber 145 are all formed as a result of baffle member 110 being received within outer cylinder 120, whereby said chambers 140 have a variety of different functions. As a result, baffle member 110 is employed to cause separation of solid propellant from fluids in order for said solids to be able to be caught and thus slowly burned within said sound suppressor assembly 100.

Figure 3C:
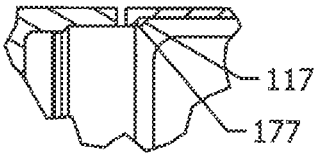
FIG. 3*c* depicts an enhanced view of an alternate embodiment of a mating relationship of an outer cylinder, a baffle member, and a base member of a parallel path firearm sound suppressor assembly.
Figure 3A:
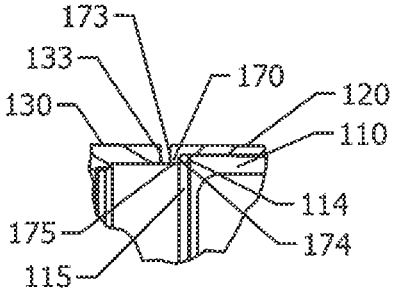
FIG. 3*a* depicts an enhanced view of a preferred embodiment of a mating relationship of an outer cylinder, a baffle member, and a base member of a parallel path firearm sound suppressor assembly.
Figure 3B:
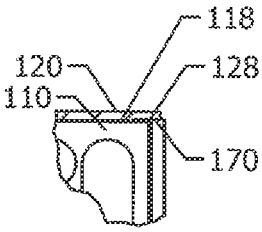
FIG. 3*b* depicts an enhanced view of a preferred embodiment of an outer cylinder and a baffle member of a parallel path firearm sound suppressor assembly of the present invention in an assembled configuration.
Figure 3:
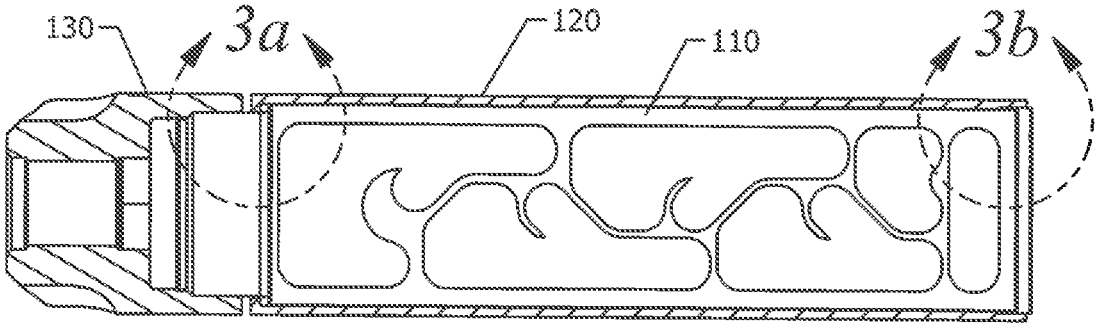
FIG. 3 depicts a sectional view of a preferred embodiment of a parallel path firearm sound suppressor assembly of the present invention in a loosely assembled configuration to illustrate points of contact between the component parts.

FIG. 3 depicts a longitudinal sectional view of sound suppressor assembly 100 in a loosely assembled configuration, generally comprising outer cylinder 120, monolithic baffle 110, and base member 130. FIGS. 3*a*, 3*b*, and 3*c* depict enhanced views from FIG. 3, further illustrating the relationships of the component parts of sound suppressor assembly 100 when in an assembled configuration.

In a preferred embodiment, proximal end 121 of outer sleeve 120 comprises a flange member 170 extending in a radially inward direction to the extent that an inner cylindrical surface 175 of flange 170 achieves a substantially contact fit with a radial shoulder 115 of baffle member 110. As sound suppressor assembly 100 is assembled, a planar bearing face 133 of base 130 makes substantially coplanar contact with a planar bearing face 173 of flange 170 of outer sleeve 120. As base member 130 approaches baffle member 110, a planar distal inner face 174 of flange 170 makes coplanar contact with a planar proximal bearing face 114 of baffle member 110. As a result, said component parts of sound suppressor assembly 100 become axially aligned as sleeve flange member 170 is impinged between base 130 and baffle member 110, thereby allowing said components to move longitudinally independent of each other due to thermal expansion or a plurality of different forces experienced during use.

In an alternative embodiment, as illustrated in FIG. 3*c*, the planar bearing face at distal inner face 174 of flange 170 and proximal bearing face 114 of baffle 110 and a contact fit between said inner cylindrical surface 175 of the flange 170 and said radial shoulder 115 are replaced with a substantially concave conical bearing surface 177 on a distal inner surface of said flange 170 and a mating convex conical bearing surface 117 of said baffle 110. Further, concomitant to the positioning of proximal end 121 of outer sleeve 120 to baffle member 110, an internal cylindrical surface 128 of distal end 122 of outer sleeve 120 can mate with an external cylindrical shoulder 170 concentric to said cylindrical surface 128 and near distal end 112 of baffle member 110.

Figure 4:
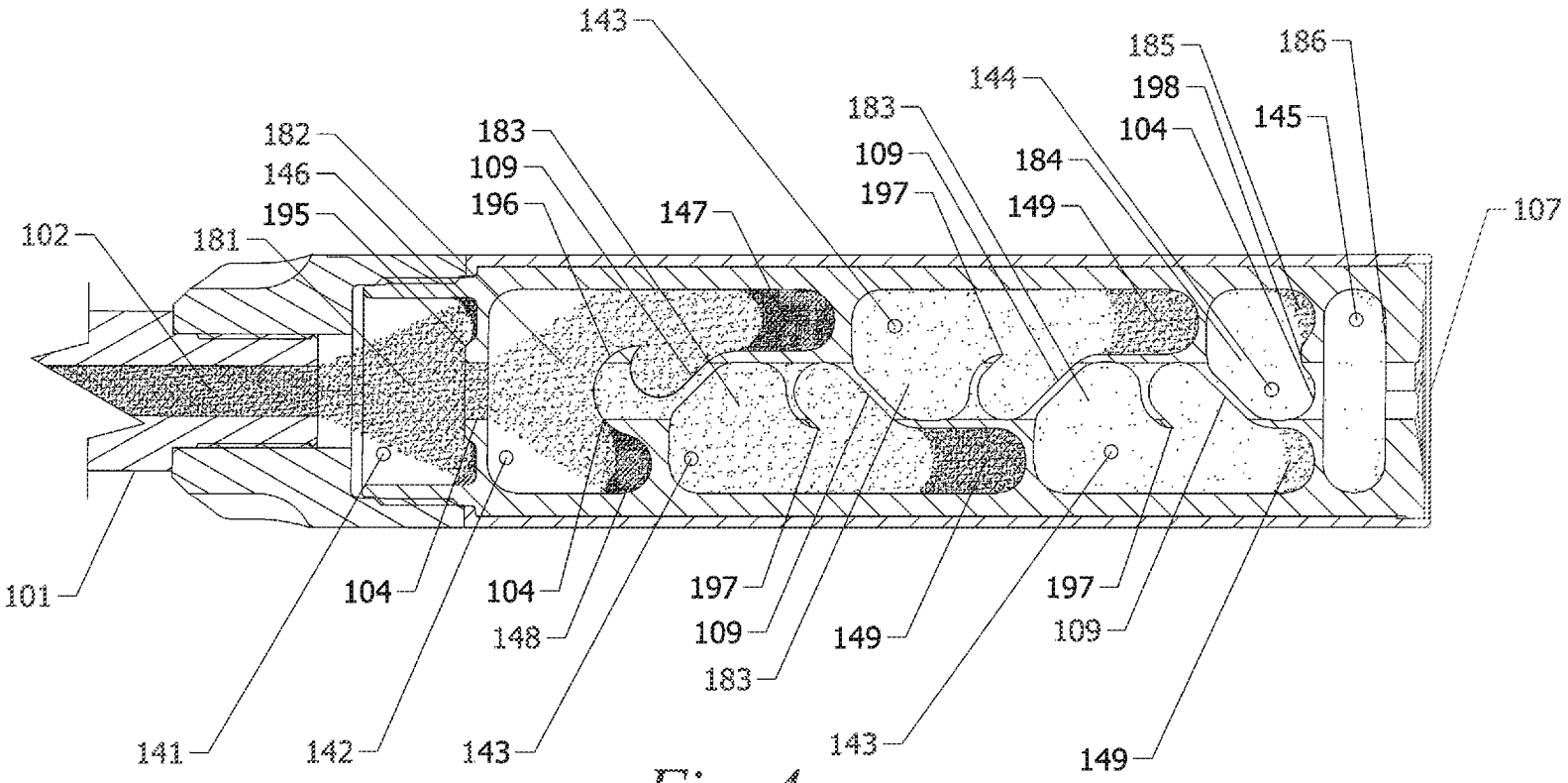
FIG. 4 depicts a sectional view of a preferred embodiment of a parallel path firearm sound suppressor assembly of the present invention illustrating the treatment of solids in a method of parallel path firearm sound suppression.

FIG. 4 depicts a longitudinal sectional view of an embodiment of sound suppressor assembly 100 in an assembled configuration generally comprising outer container 120, baffle member 110, and base member 130. Operationally, sound suppressor assembly 100 is able to remove a plurality of suspended solids from a propellant gaseous flow stream to a variety of different areas within the chambers that are relatively isolated from the flow stream. The propellant gas and solids enter sound suppressor assembly 100 from within a barrel 102 of a firearm 101 into the proximal chamber 141. As propellant burns and gases expand, increasing pressure forces the fluids to flow towards areas of substantially lower pressure. The solid propellant particles 181 move in a substantially forward direction within chamber 141 to continue through the bullet pathway hole 104, remain substantially suspended within the gas and are ejected through the bullet pathway hole 104 with the exiting solid-gas suspension, or adhere to the inside surfaces 146 of chamber 141 where they continue to burn or remain as residue. A diverter member 195 partially isolates the deposited solids from the gas flow and prevents deposited solids from obscuring the bullet pathway hole 104.

Remaining mobile solids and gases 182 continue into first baffle chamber 142 and move either substantially forward through bullet pathway hole 104 or are diverted by a diverter member 196 towards a plurality of areas 147, 148 where said solids and gases 182 are then partially isolated from the gaseous flow and wherein some of the solids are deposited where they continue to burn or remain as residue.

Remaining mobile solids and gases 183 can enter subsequent chamber 143 via a plurality of holes 109 created by the bullet pathway hole 104 intersecting a canted portion of the chamber walls. Said mobile solids and gases 183 then move in a substantially transverse direction to a longitudinal axis of sound suppressor assembly 100 until diverted by the walls of the chamber and a diverter vane 197 towards an area 149 where solids and gases 183 are partially isolated from the gaseous flow and wherein some of the solids are deposited where they continue to burn or remain as residue. This process is repeated within each of the subsequent chambers 143. It is to be observed that the number of subsequent chambers required within sound suppressor assembly 100 is dependent upon a desired and specific application of sound suppressor assembly 100.

Still referring to FIG. 4, sound suppressor assembly 100 of the present invention can employ a variety of other features in order to manage the nature of the gaseous flow as it exits the device. Any remaining mobile solids and gas 184 can enter transitional chamber 144 via a hole 109 created by the bullet pathway hole 104 intersecting a canted portion of the chamber wall and move in a substantially transverse direction to the longitudinal axis of sound suppressor assembly 100 until encountering the inside surfaces of the chamber 144. Some solids are deposited 185 within chamber 144, and the gaseous flow is redirected into the gas ejection alignment chamber 145 through bullet pathway hole 104 in a direction substantially aligned with the longitudinal axis of the present invention. A diverter member 198 partially isolates the deposited solids from the gas flow and prevents deposited solids 185 from obscuring bullet pathway hole 104.

Remaining mobile solids and gas can enter gas ejection alignment chamber 145 via bullet pathway hole 104 and move in a substantially aligned direction with the longitudinal axis of sound suppressor assembly 100 until encountering the inside surfaces of chamber 145 or ejecting through the distal end 107 of sound suppressor assembly 100 through bullet pathway hole 104 in a direction substantially aligned with the longitudinal axis of the present invention. As a result, some solids are deposited 186 within chamber 145 where they continue to burn or remain as residue.

In an alternate embodiment, a planar structure aligned with the longitudinal axis of sound suppressor assembly 100 divides the volumes defined by the baffle 110 geometry, increases surface area upon which solids can be deposited, improves isolation of deposited solids, provides rigidity to the structure, provides conductive material through which heat is transferred for dissipation, and provides structure upon which features can be included that would not be otherwise practical.

Figure 5A:
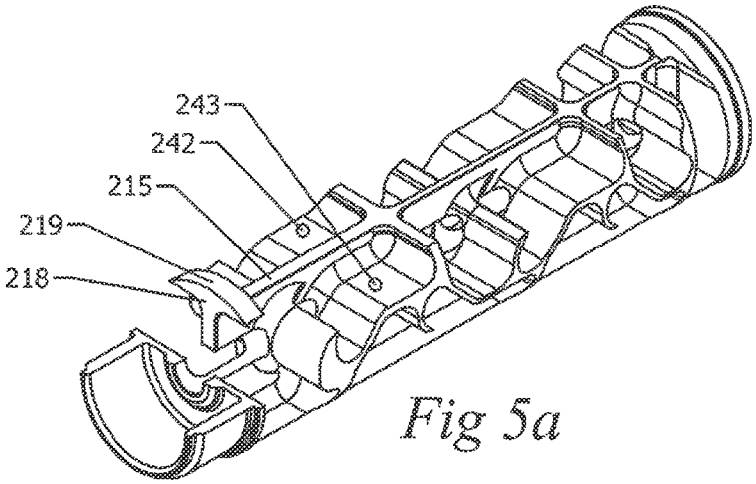
FIG. 5*a* depicts a perspective view of an alternate embodiment of a baffle of a parallel path firearm sound suppressor assembly of the present invention.
Figure 5B:
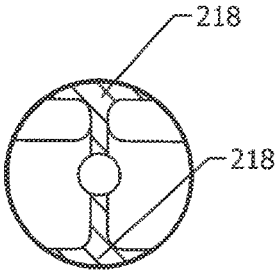
FIG. 5*b* depicts an enhanced view of an alternate embodiment of a parallel path firearm sound suppressor assembly of the present invention.
Figure 5:
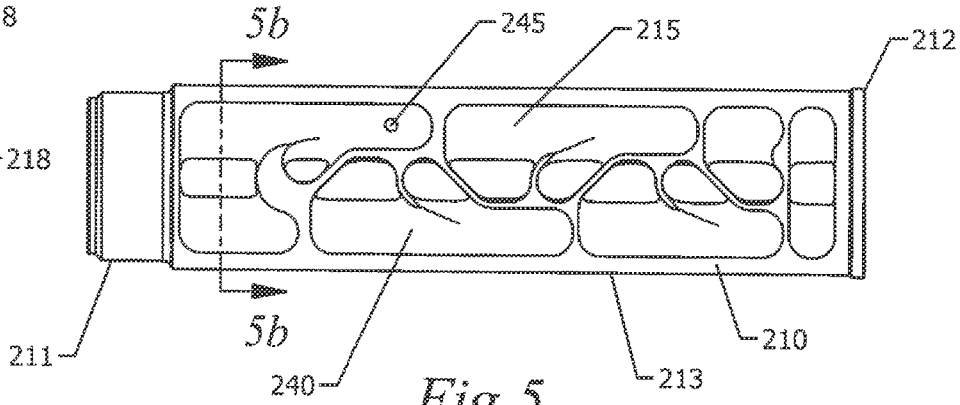
FIG. 5 depicts a side view of an alternate embodiment of a parallel path firearm sound suppressor assembly of the present invention.

FIG. 5 depicts a side view of an alternate embodiment of sound suppressor assembly 100 comprising an alternate baffle member 210, wherein alternate baffle member 210 comprises a longitudinal divider 215. FIGS. 5*a* and 5*b* depict a perspective view and a cross-sectional view, respectively, of alternate baffle member 210. Alternate baffle member 210 comprises a substantially cylindrical body member, having an outer diameter 213, a proximal end 211, and a distal end 212. Outer diameter 213 of alternate baffle member 210 is slightly less than inner diameter 124 of outer cylinder 120. Additionally, body member of alternate baffle member 210 comprises a plurality of openings, or chambers 240, for use in producing a specific effect, such as, for example, solid and fluid separation.

Further, as illustrated in FIGS. 5*a* and 5*b*, in an alternate embodiment, alternate baffle member 210 comprises a plurality of—typically two—"T-beam" structures 218 that are formed by an intersection of longitudinal divider 215 and a substantially semi-circular wall section 219 of said baffle 210. As a result, longitudinal divider 215 bifurcates chamber 142, thereby allowing chamber 142 to function as two separate chambers 242 and 243, wherein said chambers 242 and 243 can comprise either similar or independent functions. The consequences of bifurcation by longitudinal divider 215 can also apply to the subsequent chambers 143, transition chamber 144 and gas ejection alignment chamber 145.

Figure 6:
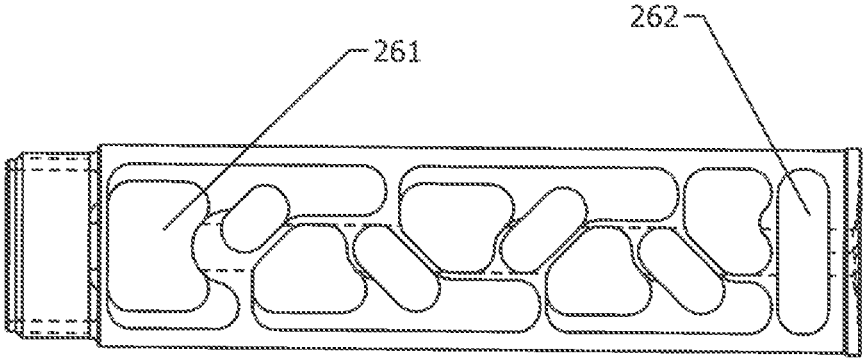
FIG. 6 depicts a side view of an alternate embodiment of a baffle of a parallel path firearm sound suppressor assembly of the present invention.

FIG. 6 depicts a side view of an alternate embodiment of sound suppressor assembly 100 of the present invention, wherein longitudinal divider 215 can be modified into a variety of different configurations. As such, a variety of different features and specifications of sound suppressor assembly 100 can be modified by selectively communicating the bifurcated chambers with either partial removal 261 or by complete removal 262 of the material defining said longitudinal divider 215.

Figure 7C:
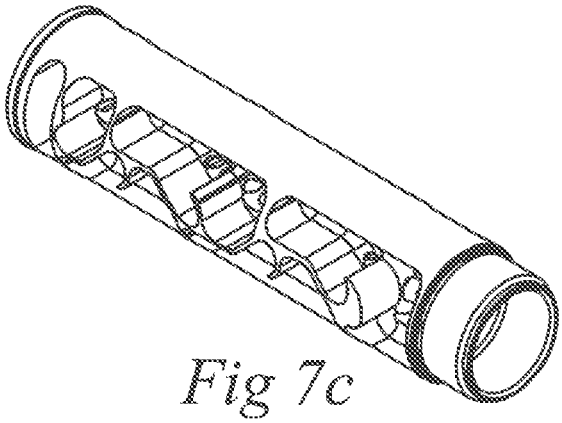
FIG. 7*c* depicts a perspective view of an additional alternate embodiment of a baffle of a parallel path firearm sound suppressor assembly of the present invention.
Figure 7D:
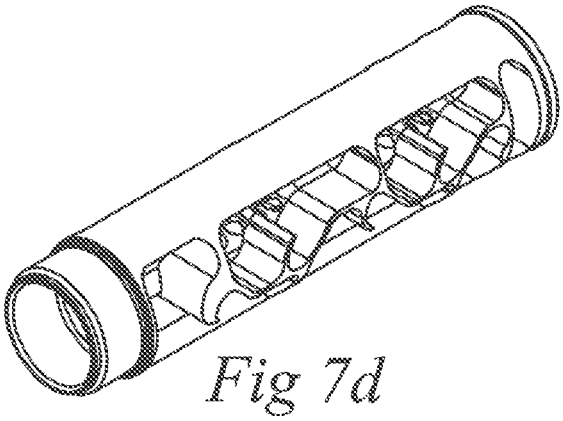
FIG. 7*d* depicts an alternate perspective view of an additional alternate embodiment of a baffle of a parallel path firearm sound suppressor assembly of the present invention.
Figure 7B:
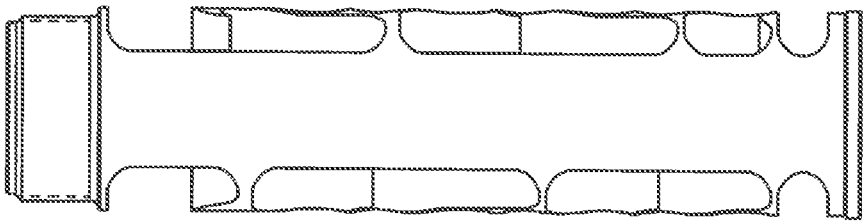
FIG. 7*b* depicts a top view of an additional alternate embodiment of a baffle of a parallel path firearm sound suppressor assembly of the present invention.
Figure 7A:
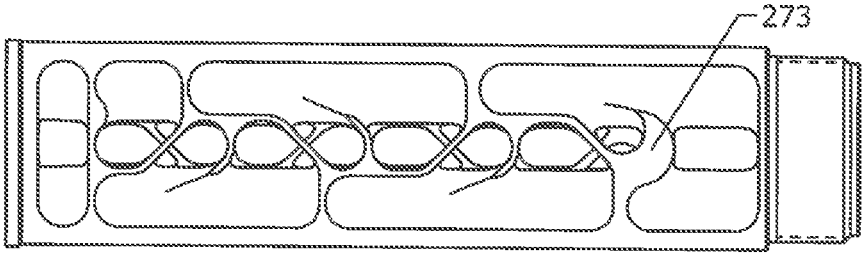
FIG. 7*a* depicts a side view of an additional alternate embodiment of a baffle of a parallel path firearm sound suppressor assembly of the present invention.
Figure 7:
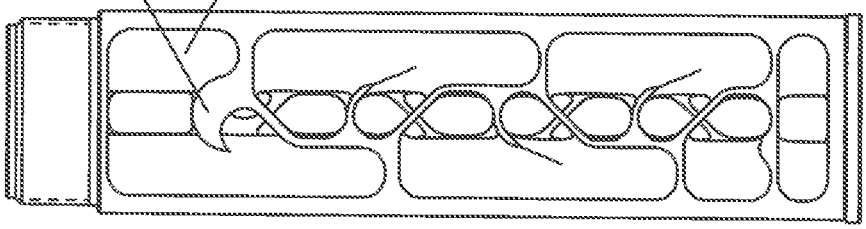
FIG. 7 depicts a side view of an additional alternate embodiment of a baffle of a parallel path firearm sound suppressor assembly of the present invention.

FIG. 7 depicts a side view of an alternate embodiment of baffle member 210 of the present invention comprising longitudinal divider 215. As such, the addition of longitudinal divider 215 can create a plurality of additional embodiments of sound suppressor assembly 100. Further, it is to be observed that baffle geometry need not be identical on both sides of said longitudinal divider 215. As depicted in FIGS. 7*a*-7*d*, baffle geometries 272 and 273 can be opposite on either side of said longitudinal divider 215.

Figure 8:
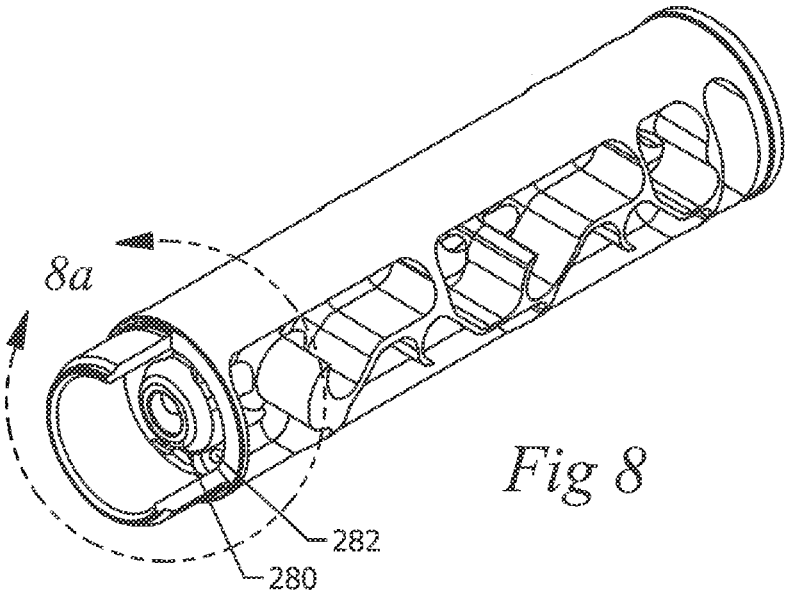
FIG. 8 depicts a perspective view of an alternate embodiment of a baffle of a parallel path firearm sound suppressor assembly of the present invention.
Figure 8A:
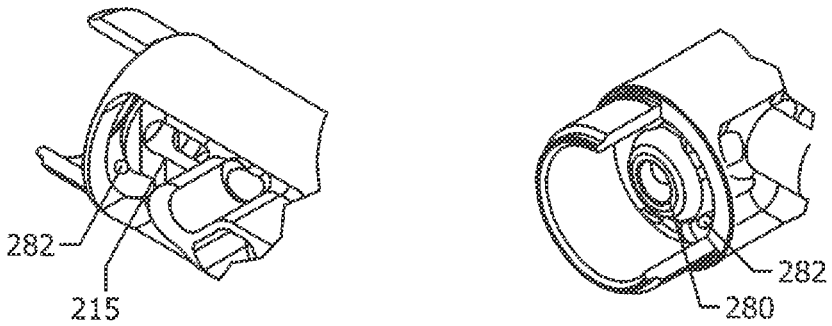
FIG. 8*a* depicts a perspective view of an alternate embodiment of a baffle of a parallel path firearm sound suppressor assembly of the present invention.

FIG. 8 depicts a perspective view of an alternate embodiment of baffle member 210 comprising a blast diffuser 280, wherein said blast diffuser 280 can reduce a concentration of unburned propellant that is introduced directly into bullet pathway hole 104. Blast diffuser 280 diverts solid and gaseous flow away from bullet pathway hole 104, wherein solids are more efficiently directed to deposition features previously described. As illustrated in FIG. 8*a*, a substantially toroidal shaped blast diffuser 280 can divert solids and gases to a plurality of semi-annular passage ways 282 that are formed by diffuser 280 and the cylindrical walls of proximal chamber 141.

Figure 9B:
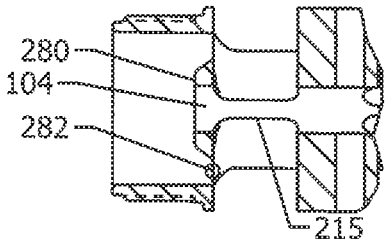
FIG. 9*b* depicts an enhanced cross-sectional view of an alternate embodiment of a baffle of a parallel path firearm sound suppressor assembly of the present invention.
Figure 9A:
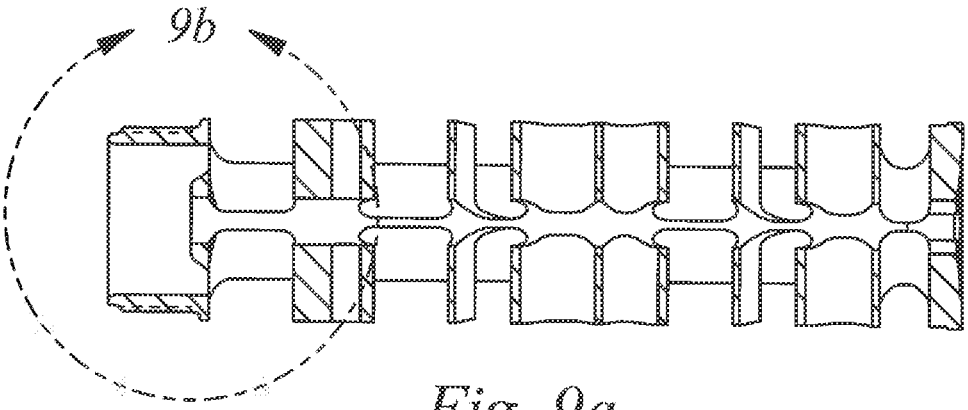
FIG. 9*a* depicts a cross-sectional view of an alternate embodiment of a baffle of a parallel path firearm sound suppressor assembly of the present invention.
Figure 9:
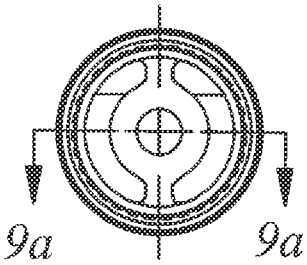
FIG. 9 depicts an end view of an alternate embodiment of a baffle of a parallel path firearm sound suppressor assembly of the present invention.
Figure 10A:
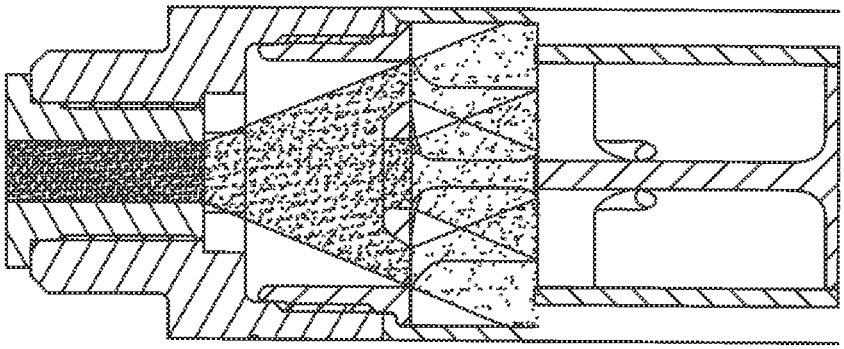
FIG. 10*a* depicts a sectional view of an alternate embodiment of a parallel path firearm sound suppressor assembly of the present invention.
Figure 10:
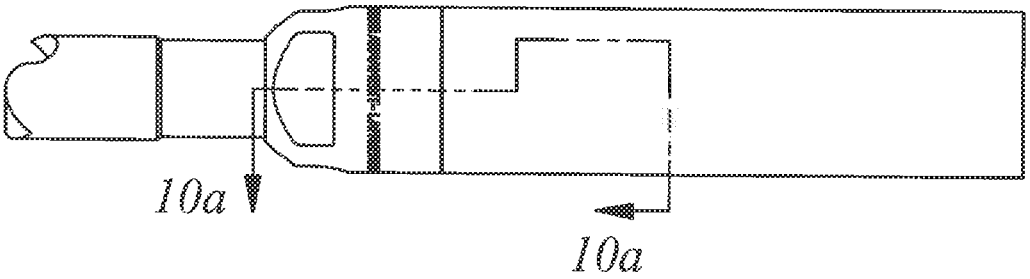
FIG. 10 depicts a side view of an alternate embodiment of a parallel path firearm sound suppressor assembly of the present invention.

FIGS. 9*a* and 9*b* depict longitudinal sectional views of an alternate embodiment of baffle member 210 comprising blast diffuser 280. FIG. 10*a* depicts a longitudinal sectional view of an alternate embodiment of sound suppressor assembly 100 comprising blast diffuser 280, further illustrating an idealized effect of blast diffuser 280 on solids.

Figure 11:
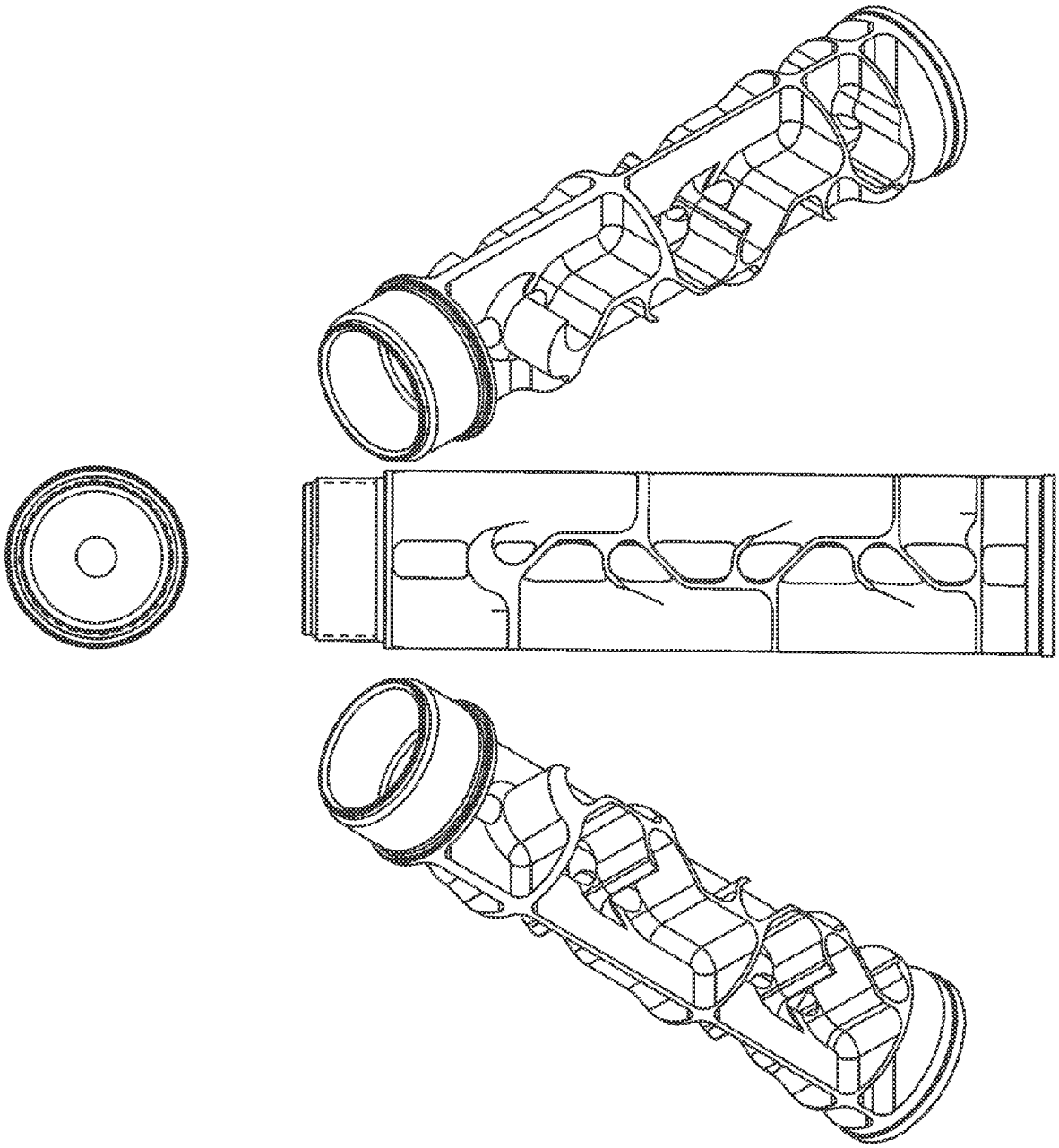
FIG. 11 depicts multiple views of an alternate embodiment of a baffle of a parallel path firearm sound suppressor assembly of the present invention.

FIG. 11 depicts multiple views of an alternate embodiment of sound suppressor assembly 100, comprising another alternate monolithic baffle member, wherein said baffle is manufactured without a semi-circular wall section. As a result, said alternate embodiment of baffle member can be substantially easier to manufacture and have a substantially lighter weight, thus producing a variety of different and desired effects for a specific application of the device.

Figure 12A:
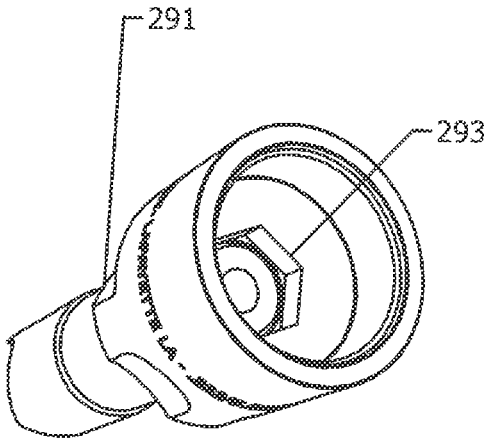
FIG. 12*a* depicts a perspective view of an alternate embodiment of a base member of a parallel path firearm sound suppressor assembly of the present invention comprising a hex broach member.
Figure 12B:
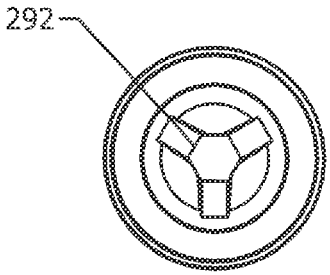
FIG. 12*b* depicts an end view of an alternate embodiment of a parallel path firearm sound suppressor assembly of the present invention comprising a hex broach member.
Figure 12:
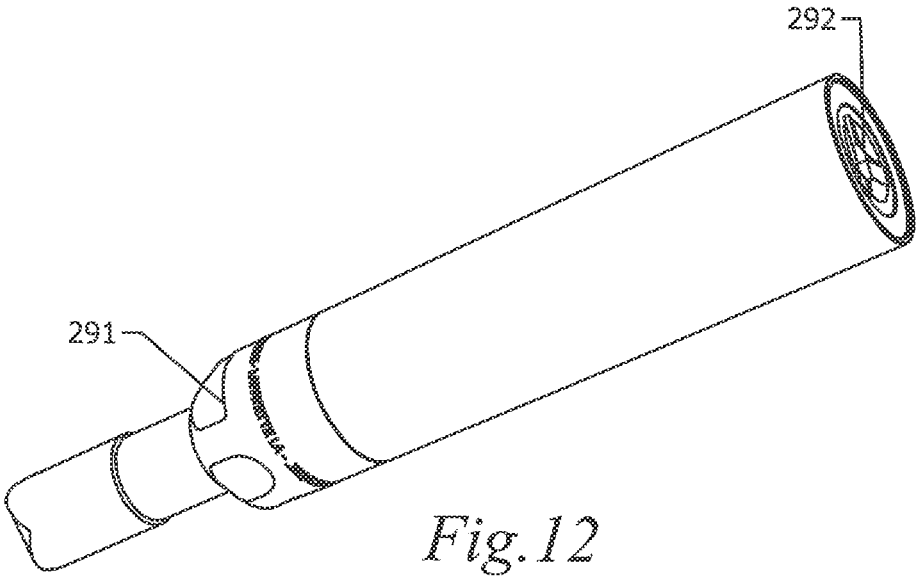
FIG. 12 depicts a perspective view of an alternate embodiment of a parallel path firearm sound suppressor assembly of the present invention comprising a variety of different additional features for use in maintenance of said assembly.

FIG. 12 depicts a perspective view of an alternate embodiment of sound suppressor assembly 100 of the present invention, comprising a variety of different additional features for use in maintenance of the device, such as, for example, a wrench flat 291 on said base 130 and a hex wrench broach 292 on said baffle 110. FIG. 12*a* depicts a perspective view of an alternate embodiment of base member 130 of sound suppressor assembly 100 of the present invention comprising a hex wrench broach member 293 located on an interior of said base 130. FIG. 12*b* depicts an end view of an alternate embodiment of sound suppressor assembly 100 of the present invention comprising a hex wrench broach 292 located on said baffle 110.

In an alternate embodiment, the present invention can comprise a plurality of—typically two—wrench flats 291 that are substantially parallel to at least one other wrench flat 291 and to the longitudinal axis of sound suppressor assembly 100 of the present invention. Said hex wrench broach 292 on baffle 110 is coincident with and coaxial to bullet pathway hole 104 at the distal end of baffle 110 and is generally configured in a size that would not interfere with the bullet in flight. Said hex wrench broach 293 on the distal face of the bottom of the thread bore 136 is coincident with and coaxial to the through hole 105 in the base 130 and is generally configured in a size that would not interfere with the bullet in flight. As a result, said additional features can be used to assist in removing base 130 from a firearm muzzle.

The above-described invention has a number of particular features that should preferably be employed in combination, although each is useful separately without departure from the scope of the invention. While the preferred embodiment of the present invention is shown and described herein, it will be understood that the invention may be embodied otherwise than herein specifically illustrated or described, and that certain changes in form and arrangement of parts and the specific manner of practicing the invention may be made within the underlying idea or principles of the invention.

What is claimed:

1. An apparatus for suppressing sound from a firearm by separating a plurality of solids from a combined fluid flow of a plurality of solids, a plurality of gases, and a solid and gas suspension, wherein said apparatus comprises a core member having a proximal end, a distal end, an outer surface, and a plurality of inner surfaces, wherein said outer surface and said inner surfaces define a plurality of features that are oriented in a manner to facilitate solid and fluid separation, further comprising:

a) an outer sleeve member having a proximal end, a distal end, an outer surface, an inner surface defining an inner chamber, and a flange located at said proximal end, wherein said proximal end and said distal end each comprise an opening;

b) a base member having a proximal end and a distal end, wherein:

i. said proximal end and said distal end each comprise an opening;

ii. said proximal end is attachably connected to a firearm;

iii. said flange of said outer sleeve is impinged between said core member and said base member; and iv. said core member and said outer sleeve are able to axially expand independent of each other.

2. The apparatus of claim 1, wherein said openings of said base member and said openings of said core member are coaxially aligned, thereby defining a bullet pathway.

* * * * *